US009786425B2

(12) United States Patent
Sakaguchi et al.

(10) Patent No.: US 9,786,425 B2
(45) Date of Patent: Oct. 10, 2017

(54) CASE UNIT AND ELECTRONIC DEVICE

(71) Applicant: HITACHI METALS, LTD., Tokyo (JP)

(72) Inventors: Mutsuhito Sakaguchi, Tottori (JP); Shintaro Higashida, Tottori (JP)

(73) Assignee: HITACHI METALS, LTD., Tokyo (JP)

( * ) Notice: Subject to any disclaimer, the term of this patent is extended or adjusted under 35 U.S.C. 154(b) by 332 days.

(21) Appl. No.: 14/414,306

(22) PCT Filed: Jul. 16, 2013

(86) PCT No.: PCT/JP2013/069261

§ 371 (c)(1),
(2) Date: Jan. 12, 2015

(87) PCT Pub. No.: WO2014/010749

PCT Pub. Date: Jan. 16, 2014

(65) Prior Publication Data

US 2015/0213938 A1 Jul. 30, 2015

(30) Foreign Application Priority Data

Jul. 13, 2012 (JP) ..... 2012-157398

(51) Int. Cl.

| | |
|---|---|
| ***H01F 27/02*** | (2006.01) |
| ***H01F 37/00*** | (2006.01) |
| ***B65D 25/10*** | (2006.01) |
| ***B65D 85/04*** | (2006.01) |
| ***H01F 27/24*** | (2006.01) |
| ***H01F 27/28*** | (2006.01) |
| ***H01F 5/02*** | (2006.01) |

(52) U.S. Cl.

CPC ..... *H01F 27/022* (2013.01); *B65D 25/108* (2013.01); *B65D 85/04* (2013.01); *H01F 5/02* (2013.01); *H01F 27/02* (2013.01); *H01F 27/24* (2013.01); *H01F 27/28* (2013.01); *H01F 27/2895* (2013.01); *H01F 37/00* (2013.01)

(58) Field of Classification Search

CPC ..... H01F 27/02; H01F 27/022; H01F 27/24; H01F 27/28; H01F 27/2895

See application file for complete search history.

(56) References Cited

FOREIGN PATENT DOCUMENTS

| | | | |
|---|---|---|---|
| JP | 10-41140 | A | 2/1998 |
| JP | 10-50534 | A | 2/1998 |
| JP | 11-135347 | A | 5/1999 |
| JP | 2006-262368 | A | 9/2006 |

(Continued)

OTHER PUBLICATIONS

International Search Report of PCT/JP2013/069261 dated Oct. 29, 2013.

*Primary Examiner* — Ronald Hinson
(74) *Attorney, Agent, or Firm* — Sughrue Mion, PLLC

(57) ABSTRACT

A case unit for containing an annular magnetic core and a coil, which comprises a first case having an annular portion having an annular space for receiving the annular magnetic core, around which the coil is wound, and pluralities of legs extending from the annular portion to one side; and a second case engaging the first case, such that it enters gaps between the annular portion and legs of the first case, and covers part of the annular portion from the one side; a first fixing portion of each leg of the first case and each second fixing portion of the second case being overlapped and fixed to a substrate.

14 Claims, 12 Drawing Sheets

(56) References Cited

FOREIGN PATENT DOCUMENTS

| | | | |
|---|---|---|---|
| JP | 2010-034228 | A | 2/2010 |
| JP | 2010-114359 | A | 5/2010 |
| JP | 2011-109499 | A | 6/2011 |

CASE UNIT AND ELECTRONIC DEVICE

CROSS REFERENCE TO RELATED APPLICATIONS

This is a National Stage of International Application No. PCT/JP2013/069261 filed Jul. 16, 2013 (claiming priority based on Japanese Patent Application No. 2012-157398 filed Jul. 13, 2012), the contents of which are incorporated herein by reference in their entirety.

FIELD OF THE INVENTION

The present invention relates to an electronic device such as a reactor, a transformer, etc. used in various power supply apparatuses, and a case unit used therein.

BACKGROUND OF THE INVENTION

Large-power electric motors are used in hybrid vehicles and electric vehicles rapidly finding wider use recently, and power converters for driving such electric motors comprise electronic devices such as reactors capable of withstanding high voltage and large current. An electronic device is constituted by a coil device contained in a metal case, the coil device comprising a coil, an insulating resin bobbin around which the coil is wound, and a magnetic core disposed in the bobbin. The metal case is filled with a potting resin (molding resin) for fixing the coil device. The metal case is firmly fixed to metal plates and heat sinks acting as cooling means, frames, circuit boards, etc., which may be called "substrates" in general, by fastening means such as bolts, lest that it is easily detached by the mechanical vibration of vehicles.

Because battery voltage of several hundreds of volts is supplied to the coil, high electric insulation is required between a coil and a core and a metal case to prevent the breakage of the electronic device, or current leak and electric shock. Accordingly, insulating resins such as epoxy resins, silicone resins, etc. are used as the potting resin.

In an electronic device comprising a coil device fixed by a potting resin in a metal case, cracking likely occurs in the potting resin or its boundary with the metal case, because of thermal stress due to thermal expansion difference between the potting resin and the metal case, mechanical vibration applied to the electronic device, etc. As a result, sufficient heat dissipation is not obtained, and the fixing of the coil device is likely damaged.

To cope with such problems, as shown in FIG. 23, JP 2010-34228 A proposes a reactor 500 comprising an assembly 510 comprising a coil 501 and an annular magnetic core 502 supporting the coil 501, a metal case 512 containing the assembly 510, and a potting resin 514 filling a gap between the metal case 512 and the assembly 510; the metal case 512 having an open box shape having a bottom wall and side walls; and inner surfaces of the side walls being provided with raggedness 512*a* in contact with the potting resin 514. The raggedness 512*a* on the side walls of the metal case 512 provides a large contact area between the metal case 512 and the potting resin 514, with high adhesion therebetween, so that the assembly 510 is not easily detached from the metal case 512 even if the potting resin 514 is cracked.

In the structure disclosed in JP 2010-34228 A, however, the side walls of the metal case 512 should have large or much raggedness to have higher adhesion between the metal case 512 and the potting resin 514, so that the metal case 512 has a complicated shape, and thus suffers an increased production cost. Because the assembly (coil device) 510 is still fixed by the potting resin 514, solution has not been achieved in the fundamental problems that the cracking of the potting resin 514 and gaps between the potting resin 514 and the metal case 512 deteriorate the fixing of the coil device 510, resulting in reduced heat dissipation.

OBJECT OF THE INVENTION

Accordingly, the first object of the present invention is to provide a case unit capable of surely fixing a coil device despite an easy-to-assemble, simple structure.

The second object of the present invention is to provide a case unit with suppressed cracking in a potting resin fixing the coil device.

The third object of the present invention is to provide an electronic device comprising such a case unit, which is suitably mounted in automobiles.

SUMMARY OF THE INVENTION

As a result of intensive research in view of the above objects, the inventors have found that when a case unit for supporting an annular magnetic core and a coil is constituted by a first case for winding the coil around the annular magnetic core, and a second case filled with a potting resin for fixing the coil, both of the first and second cases being provided with structures to be fixed to a substrate, it can surely fix the coil device while suppressing the cracking of the potting resin, despite an easy-to-assemble simple structure. The present invention has been completed based on such finding.

Thus, the case unit of the present invention for containing an annular magnetic core and a coil comprises

- a first case having an annular portion having an annular space for receiving the annular magnetic core, around which the coil is wound, and pluralities of legs extending from the annular portion to one side; and
- a second case engaging the first case, such that it enters gaps between the annular portion and legs of the first case, and covers part of the annular portion from the one side;
- a first fixing portion of each leg of the first case and each second fixing portion of the second case being overlapped and fixed to a substrate.

It is preferable that each of the first and second fixing portions has a penetrating hole or a notch, and that the first and second fixing portions are fixed to the substrate by fastening parts, with their penetrating holes or notches overlapped.

Each leg of the first case preferably comprises a side projection projecting outward from the annular portion, an extension extending downward from each of the side projections, and the fixing portion provided in a tip end portion of the extension.

It is preferable that one of plural legs of the first case has a side projection projecting outward from the annular portion, an upper projection projecting from an upper surface of the annular portion integrally with the side projection, an extension extending downward from the side projection, and the fixing portion provided in a tip end portion of the extension; and that the upper projection has at least one penetrating hole or notch through which an end portion of a coil wire penetrates.

The side projection of the first case preferably has a groove for receiving the cylindrical portion of the second case.

It is preferable that the first doughnut-shaped member has a first annular space having an open end; that the second doughnut-shaped member has a second annular space having an open end; and that when the first doughnut-shaped member engages the second doughnut-shaped member, the first annular space is integrally connected to the second annular space to constitute a closed annular space for receiving the annular magnetic core.

In an embodiment of the present invention, the first doughnut-shaped member has a lower open end; the second doughnut-shaped member has an upper open end; and the first doughnut-shaped member engages the second doughnut-shaped member from above.

In another embodiment of the present invention, the first doughnut-shaped member has an upper open end; the second doughnut-shaped member has a lower open end; and the first doughnut-shaped member engages the second doughnut-shaped member from below.

The first doughnut-shaped member preferably telescopically engages the second doughnut-shaped member.

It is preferable that the second case is constituted by a first member comprising a cylindrical portion, and a second member comprising a bottom plate; that the first member is made of an insulating resin; and that the second member is made of a metal.

It is preferable that a lower end of the cylindrical portion of the first member is integrally provided with an annular bottom portion; and that the annular bottom portion of the first member is fixed to the bottom plate of the second member, so that the bottom plate is exposed in a center opening of the annular bottom portion.

The cylindrical portion of the second case preferably has recesses extending along a center axis for receiving the legs of the first case.

The second member preferably has fixing portions integral with the bottom plate.

The electronic device of the present invention comprising the above case unit comprises

- a coil device comprising an annular magnetic core contained in the annular portion of the first case, and a coil wound around the annular portion of the first case;
- the second case containing the coil device; and
- a potting resin filling the second case for fixing the coil device to the second case.

BRIEF DESCRIPTION OF THE DRAWINGS

FIG. 4(*b*) is a cross-sectional view taken along the line B-B in FIG. 3.

FIG. 12(*b*) is a cross-sectional view taken along the line D-D in FIG. 12(*a*).

FIG. 12(*c*) is a view showing the bottom of the second doughnut-shaped member of FIG. 12(*a*).

DESCRIPTION OF THE PREFERRED EMBODIMENTS

Figure 1:
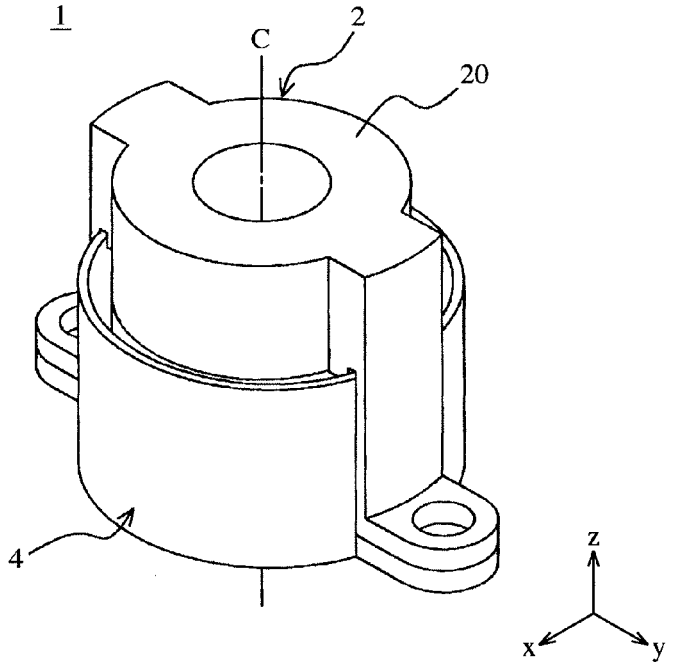
FIG. 1 is a perspective view showing the appearance of a case unit in the first embodiment of the present invention.

The embodiments of the present invention will be explained in detail below without intention of restricting the present invention thereto. Various additions and modifications may be made within the technical idea of the present invention. Explanations of each embodiment are applicable to other embodiments unless otherwise mentioned. In any embodiments, the same reference numerals are assigned to the same portions. Because "upper" and "lower" used in the following explanations are relative expression shown in the figures, the rephrasing of "upper" to "lower", for example, does not mean the change of the structure.

[1] First Embodiment (A) Case Unit

FIG. 1 shows a case unit 1 in the first embodiment of the present invention. The case unit 1 comprises a first case 2 for containing an annular magnetic core and having a coil wound around it, and a second case 4 for receiving the first case 2 around which the coil is wound. In FIG. 1, a coil is omitted for the simplicity of explanation. Though an annular portion of the first case 2 and a cylindrical portion of the second case 4 are both cylindrical in the depicted embodiment, they are not restrictive but may be elliptical or polygonal such as tetragonal or more in cross section.

(1) First Case

Figure 2:
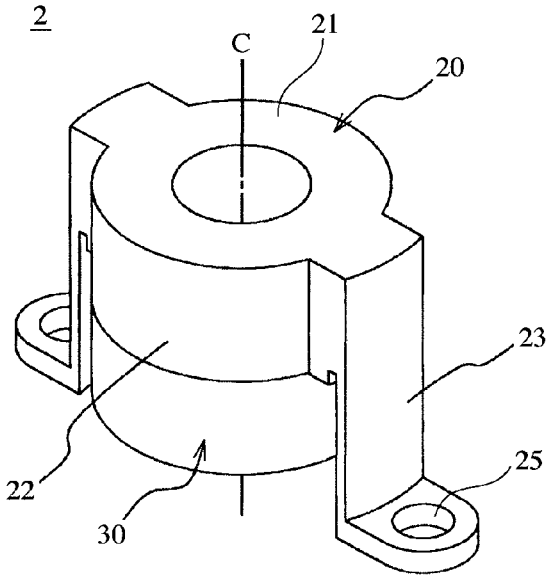
FIG. 2 is a perspective view showing the appearance of a first case used in the case unit in the first embodiment of the present invention.

FIG. 2 shows a first case 2 in the first embodiment of the present invention. The first case 2 is constituted by a first doughnut-shaped member 20 and a second doughnut-shaped member 30, which are assembled to form an annular portion.

(a) First Doughnut-Shaped Member

Figure 3:
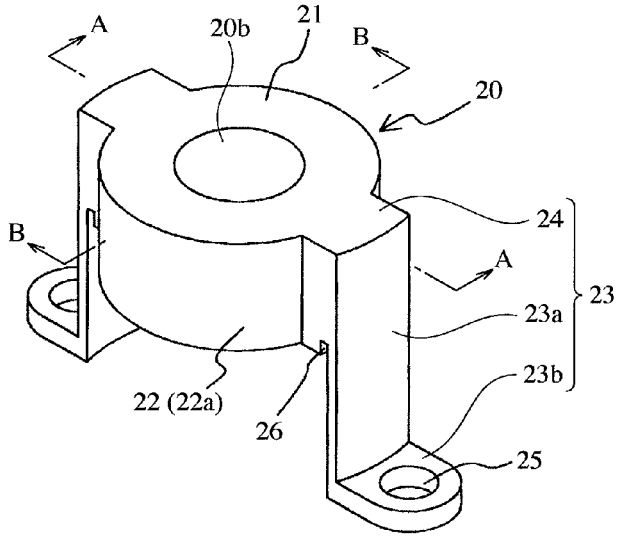
FIG. 3 is a perspective view showing the appearance of a first doughnut-shaped member constituting the first case in the first embodiment of the present invention.
Figure 4A:
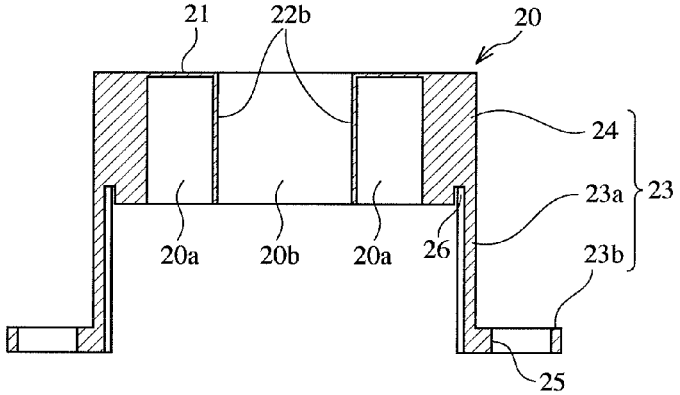
FIG. 4(*a*) is a cross-sectional view taken along the line A-A in FIG. 3.
Figure 4B:
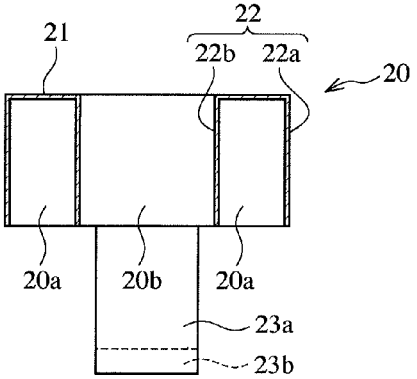

As shown in FIGS. 3, 4(*a*) and 4(*b*), the first doughnut-shaped member 20 has a doughnut-shaped upper plate portion 21, a double-wall cylindrical portion 22, and pluralities (a pair in the depicted example) of legs 23 integrally extending from an outer side surface of the double-wall cylindrical portion 22 downward in parallel with the center axis C (z direction). The double-wall cylindrical portion 22 has an outer cylindrical wall 22*a* and an inner cylindrical wall 22*b* concentrically and integrally extending downward from the doughnut-shaped upper plate portion 21, and the doughnut-shaped upper plate portion 21 and the concentric outer and inner cylindrical walls 22*a* and 22*b* constitute a one-side-closed annular space 20*a* having a lower open end to partially receive the annular magnetic core. The inner cylindrical wall 22*b* constitutes a columnar space 20*b*.

A pair of legs 23 integrally extend from an outer surface of the outer cylindrical wall 22*a* at diametrical positions (separate from each other by 180° when viewed from above), and each leg 23 has a side projection 24 projecting from the outer surface of the outer cylindrical wall 22*a*, an extension 23*a* extending downward from the side projection 24 in parallel with the center axis C, and a fixing portion 23*b* extending outward from a tip end of the extension 23*a* horizontally (in a direction perpendicular to the center axis C). Of course, the extensions 23*a* need not be completely in parallel with the center axis C, but may be inclined slightly. Though a pair of legs 23 are used in the depicted example, the number of legs 23 may be 3 or more. If a pair of legs 23 are used, they are preferably arranged on a diameter of the double-wall cylindrical portion 22 with a center angle of 180°, but if the second case 4 has another fixing portion, the center angle of the legs 23 need not be 180°. Each fixing portion 23*b* has a penetrating circular hole 25, through which a bolt threadably engaging a substrate penetrates. As long as threadably engageable with the substrate, the fixing portion may have a notch in place of the penetrating hole 25.

The side projection 24 of each leg 23 has such a size as to avoid interference when the double-wall cylindrical portion 22 (part of a closed double-wall cylindrical portion 200 in the first doughnut-shaped member 20), around which a coil is wound, is contained in the second case 4. The extension 23*a* has such a size as to separate a bottom plate of the second case 4 from a bottom plate of the double-wall cylindrical portion 22 by a predetermined gap. Though all legs 23 have the same size in the depicted example, they may have different sizes if necessary.

A lower surface of each side projection 24 has an arcuate groove 26 in contact with an inner surface of the extension 23*a*. The arcuate groove 26 has a shape receiving an upper edge portion of a cylindrical portion 42 of the second case 4 described below. The arcuate groove 26 for receiving the upper edge portion of the cylindrical portion 42 is provided if necessary, to secure the positioning of the second case 4 to the first case 2.

(b) Second Doughnut-Shaped Member

Figure 5:
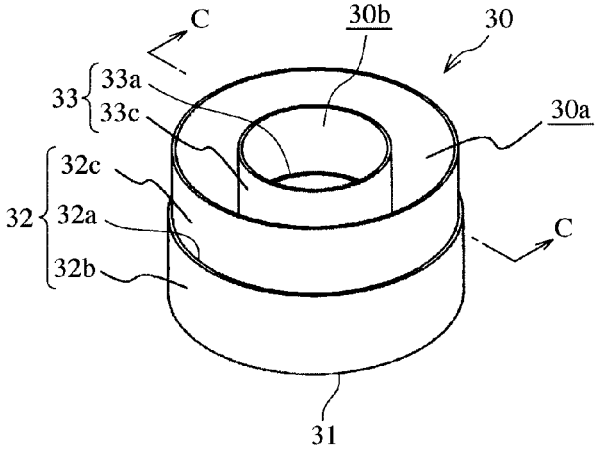
FIG. 5 is a perspective view showing the appearance of a second doughnut-shaped member constituting the first case in the first embodiment of the present invention.

As shown in FIG. 5, the second doughnut-shaped member 30 has a ring-shaped bottom plate 31, and an outer cylindrical wall 32 and an inner cylindrical wall 33 concentrically extending upward from a cylindrical edge of the ring-shaped bottom plate 31, both cylindrical walls 32, 33 having upper open ends. Like the first doughnut-shaped member 20, the cylindrical walls 32, 33 of the second doughnut-shaped member 30 constitute a double-wall cylindrical portion. The annular magnetic core is partially contained in a one-side-closed annular space 30*a* defined by the ring-shaped bottom plate 31, the outer cylindrical wall 32 and the inner cylindrical wall 33. The inner cylindrical wall 33 of the second doughnut-shaped member 30 defines the columnar space 30*b*.

Figure 6:
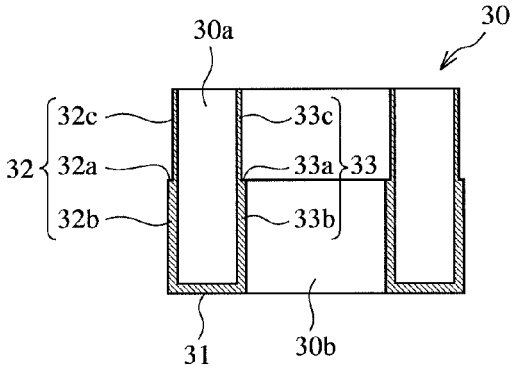
FIG. 6 is a cross-sectional view taken along the line C-C in FIG. 5.

Because the second doughnut-shaped member 30 is assembled to the first doughnut-shaped member 20, as shown in FIG. 6, an outer surface of the outer cylindrical wall 32 has an annular step 32*a* at a substantially center position, with a thick outer cylindrical wall 32*b* below the annular step 32*a* and a thin outer cylindrical wall 32*c* above. Also, an inner surface of the inner cylindrical wall 33 has an annular step 33*a* at a substantially center position, with a thick inner cylindrical wall 33*b* below the annular step 33*a* and a thin inner cylindrical wall 33*c* above.

Figure 7:
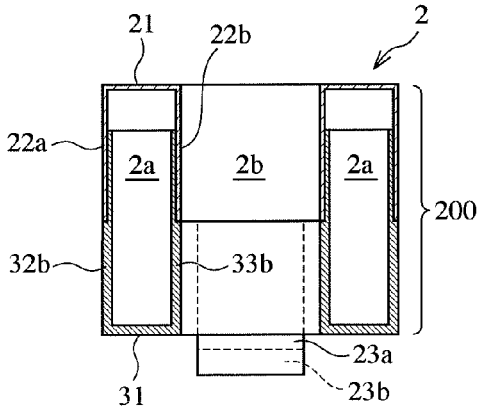
FIG. 7 is a cross-sectional view showing a double-wall cylindrical portion constituted by the first doughnut-shaped member connected to the second doughnut-shaped member.

When the first doughnut-shaped member 20 is connected to the second doughnut-shaped member 30 to form a closed double-wall cylindrical portion (annular portion) 200 as shown in FIG. 7, the one-side-closed annular space 20*a* of the first doughnut-shaped member 20 is made integral with the one-side-closed annular space 30*a* of the second doughnut-shaped member 30, forming a closed annular space 2*a* for receiving an annular magnetic core. Thus, the annular magnetic core is contained in the annular portion 200 of the first case 2. The columnar space 20*b* of the first doughnut-shaped member 20 is also made integral with the columnar space 30*b* of the second doughnut-shaped member 30 to form a penetrating center hole 2*b* through which a coil wire penetrates.

Because the thin outer cylindrical wall 32*c* and thin inner cylindrical wall 33*c* of the second doughnut-shaped member 30 are fit into a space 20*a* defined by the outer cylindrical wall 22*a* and inner cylindrical wall 22*b* of the first doughnut-shaped member 20 without clearance, an assembly of the first doughnut-shaped member 20 and the second doughnut-shaped member 30 has substantially no steps in an outer surface between the outer cylindrical wall 22*a* and the thick outer cylindrical wall 32*b*, and in an inner surface between the inner cylindrical wall 22*b* and the thin inner cylindrical wall 33*c*.

(2) Second Case

Figure 8:
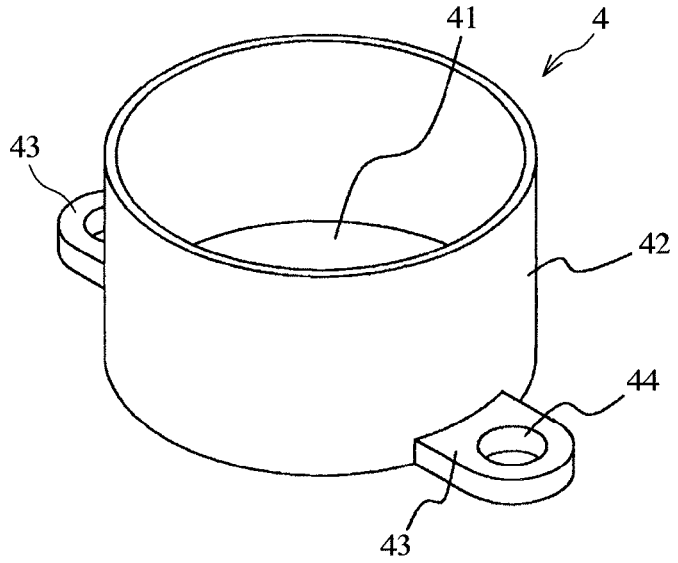
FIG. 8 is a perspective view showing the appearance of a second case in the first embodiment of the present invention.
Figure 9:
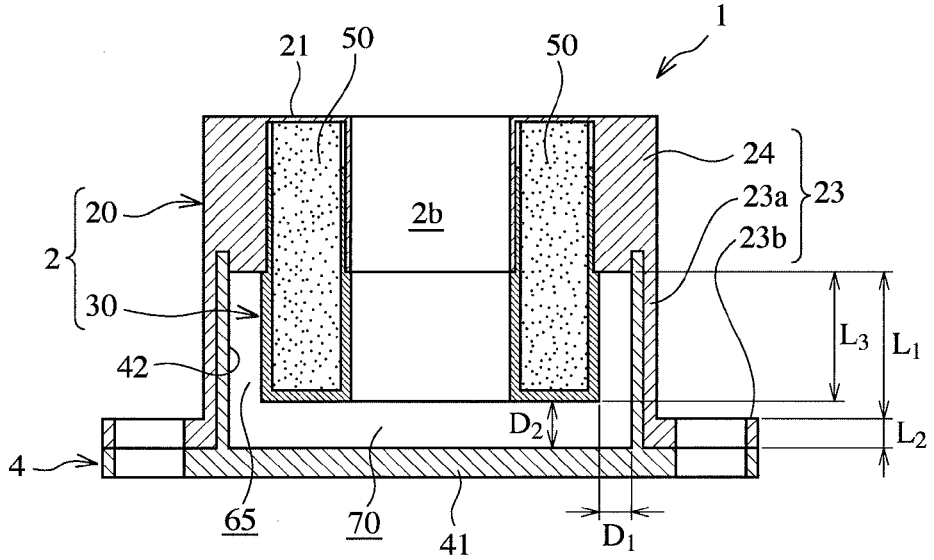
FIG. 9 is a cross-sectional view showing a case unit obtained by assembling the second case to the first case.

As shown in FIG. 8, the second case 4 has a circular bottom plate 41, a cylindrical portion 42 vertically extending upward from a circular edge of the circular bottom plate 41, and a pair of fixing portions 43, 43 extending diametrically from a periphery of the circular bottom plate 41, each fixing portion 43 having a penetrating hole 44 through which a bolt penetrates. The penetrating hole 44 of each fixing portion 43 of the second case 4 is located at a position corresponding to the penetrating hole 25 of each fixing portion 23*b* of the first doughnut-shaped member 20 of the first case 2. In place of the penetrating hole 44, a notch may be used. Because the cylindrical portion 42 of the second case 4 enters gaps between the outer cylindrical wall 32 and extensions 23*a* of the first case 2 when the first case 2 is received in the second case 4 as shown in FIG. 9, an inner surface of each extension 23*a* is preferably curved along the outer surface of the cylindrical portion 42. Also, an upper edge portion of the cylindrical portion 42 of the second case 4 is received in the arcuate grooves 26 of the first doughnut-shaped member 20. This brings the cylindrical portion 42 of the second case 4 into area contact with the extensions 23*a* of the legs 23, so that the second case 4 is accurately positioned.

With the above structure, the cylindrical portion 42 of the second case 4 is separate from the closed double-wall cylindrical portion 200 of the first case 2 by a predetermined gap $D_1$ in a transverse direction (xy direction), and the bottom plate 41 of the second case 4 is separate from a lower end of the double-wall cylindrical portion 22 of the first case 2 in a vertical direction (z direction) by a gap $D_2$, which is obtained by subtracting the length $L_3$ of the thick cylindrical walls 32*b*, 33*b* of the second doughnut-shaped member 30 from a sum of the length $L_1$ of the extensions 23*a* of the legs 23 and the thickness $L_2$ of the fixing portions 23*b*. A space 65 which is filled with a potting resin is thus defined by the closed double-wall cylindrical portion 200 around which the coil is wound, the cylindrical portion 42 and bottom plate 41 of the second case 4. Also, a space 70 which is filled with a potting resin is defined by a bottom surface of the bottom portion of the closed double-wall cylindrical portion 200 (the bottom plate 31 of the second doughnut-shaped member 30) and an upper surface of the bottom plate 41 of the second case 4.

(B) Assembling to Case Unit

Figure 10:
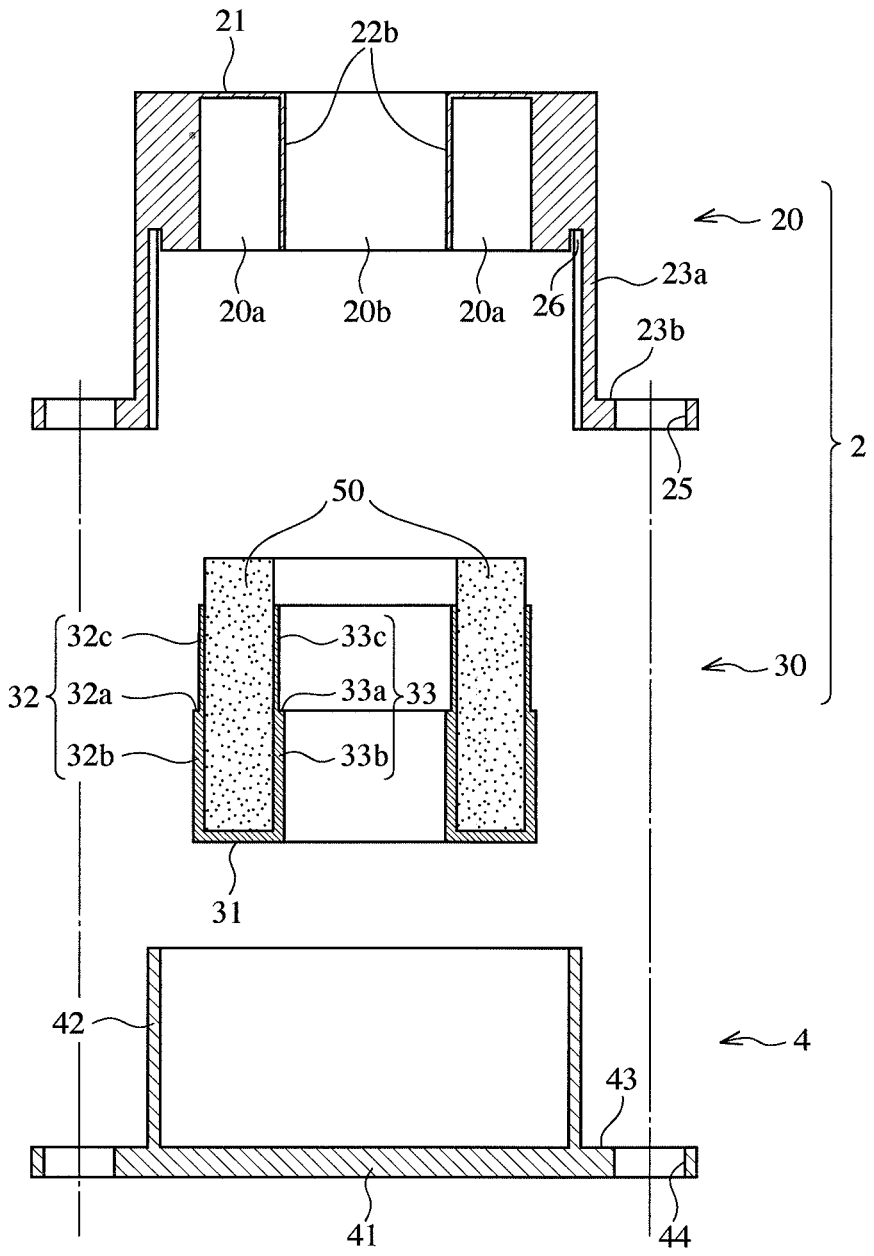
FIG. 10 is an exploded cross-sectional view showing the assembling of the second case to the first case.

As shown in FIG. 10, after the annular magnetic core 50 is put in the one-side-closed annular space 30*a* of the second doughnut-shaped member 30, the second doughnut-shaped member 30 is inserted into the one-side-closed annular space 20*a* of the first doughnut-shaped member 20 to constitute the first case 2. A coil is wound around the first case 2, which is then contained in the second case 4. Thus, the case unit 1 shown in FIGS. 1 and 9 is obtained. In FIGS. 1 and 9, the coil is omitted for simplicity.

The first case 2 and the second case 4 are mountable to a substrate, with their penetrating holes 25, 44 overlapped. When firm fixing to the substrate is required as in automobiles, fastening members such as bolts are preferably inserted into the overlapped penetrating holes 25, 44, to surely fix the first case 2 and the second case 4 to the substrate. Incidentally, fastening may be achieved by bushes inserted into the overlapped penetrating holes 25, 44.

(C) Materials

The first doughnut-shaped member 20 and the second doughnut-shaped member 30 constituting the first case 2 are preferably formed by resins having excellent insulation, heat resistance, flexibility and moldability, specifically by polyphenylene sulfide, liquid crystal polymers, polyethylene terephthalate, polybutylene terephthalate, etc. The first doughnut-shaped member 20 and the second doughnut-shaped member 30 can be formed by an injection molding method.

In an electronic device for high voltage and large current generating large heat from the coil, non-magnetic metals having excellent thermal conductivity, such as aluminum or its alloy, magnesium or its alloy, etc. may be used for the second case 4 from the aspect of heat dissipation, but it needs a sufficient gap between the coil and the second case 4, so that the second case 4 should be large. In this case, an insulator made of an insulating resin such as polyphenylene sulfide, polytetrafluoroethylene, liquid crystal polymers, etc. can be arranged between the coil and the second case 4, to reduce a gap between the coil and the second case 4.

However, the second case 4 is also preferably formed by an insulating resin like the first case 2, not only for insulation but also for the reduction of size and cost of the second case 4. The use of an insulating resin enables the case unit 1 to have a smaller size by a reduced gap between the second case 4 and the coil, with lower production cost because of easy molding, and reduced cracking because of a smaller thermal expansion difference from the potting resin.

[2] Second Embodiment

Figure 11:
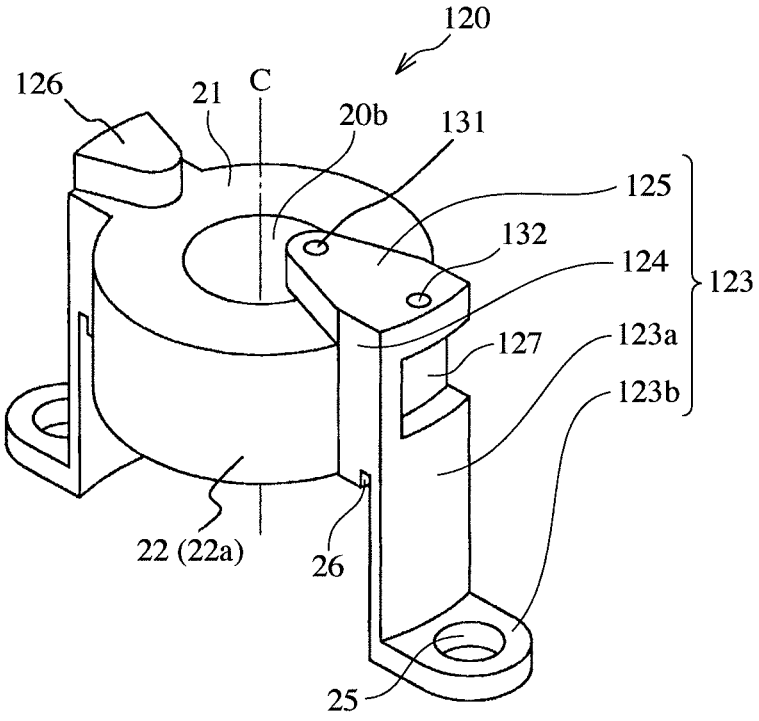
FIG. 11 is a perspective view showing a first doughnut-shaped member in the second embodiment of the present invention.

FIG. 11 shows a first doughnut-shaped member 120 of a first case 2 in the second embodiment of the present invention. The first doughnut-shaped member 120 differs from the first doughnut-shaped member 20 in the first embodiment in the structure of pluralities (a pair in the depicted example) of legs 123.

Each leg 123 has a side projection 124 projecting from the outer cylindrical wall 22*a*, an upper projection 125, 126 integral with the side projection 124 and projecting from the doughnut-shaped upper plate portion 21, an extension 123*a* extending downward from the side projection 124 in parallel with the center axis C, and a fixing portion 123*b* horizontally extending outward from a tip end portion of the extension 123*a*. To secure a sufficient winding region, each upper projection 125, 126 is tapered toward the inside of the double-wall cylindrical portion 22 (toward the columnar space 20*b*).

A pair of upper projections 125, 126 are preferably slightly higher than a coil wound around the double-wall cylindrical portion 22 (corresponding to a portion occupied by the first doughnut-shaped member 120 in the closed double-wall cylindrical portion 200). Whether or not the coil is properly wound can be judged by comparing the coil with the upper projections 125, 126 in height. The double-wall cylindrical portion 22 has improved strength by the side projection 124 and the upper projections 125, 126, which are thick in axial and radial directions of the double-wall cylindrical portion 22.

A pair of upper projections 125, 126 may have different shapes. The first upper projection 125 extends until it partially covers the columnar space 20*b* of the double-wall cylindrical portion 22, and has two guide holes 131, 132. Penetrating through the guide hole 131 open to the columnar space 20*b* is one end portion of a coil wire extending from the penetrating center hole 2*b* of the first case 2 obtained by connecting the first doughnut-shaped member 120 to the second doughnut-shaped member 30. Also, the other end portion of the coil wire penetrates through the guide hole 132 open to a recess 127 in the side projection 124, at a position outside the double-wall cylindrical portion 22. Though the guide holes 131, 132 are penetrating holes in this embodiment, they may be notches open sideward. The guide holes 131, 132 ensure the easy, high-precision positioning of end portions of the wire wound around the double-wall cylindrical portion 22 and passing through them. Also, fixing both end portions of the coil at a predetermined distance ensures the coil to keep high insulation breakdown resistance even though high voltage is applied thereto. Incidentally, the guide hole 132 may be omitted, with the other end portion of the coil wire extending upward along the outer cylindrical wall 22*a*.

The second upper projection 126 free from guide holes extends toward the penetrating center hole 2*b* to an intermediate position on the doughnut-shaped upper plate portion 21. Incidentally, all legs 123 need not be provided with upper projections, but for example, only an upper projection 125 with guide holes 131, 132 may have an upper projection.

[3] Third Embodiment

Figure 12A:
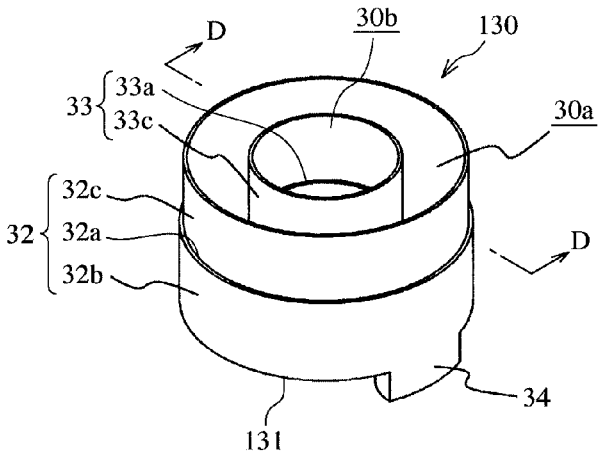
FIG. 12(*a*) is a perspective view showing the appearance of a second doughnut-shaped member in the third embodiment of the present invention.
Figure 12B:
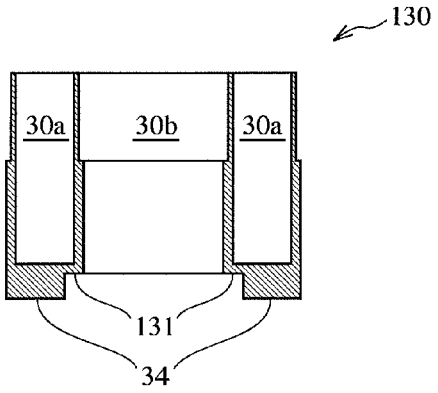
Figure 12C:
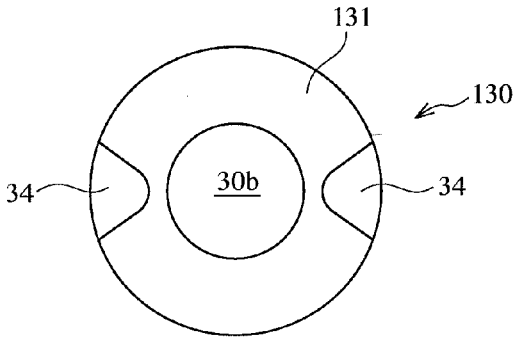

FIGS. 12(*a*)-12(*c*) show a second doughnut-shaped member 130 in the third embodiment of the present invention. The second doughnut-shaped member 130 has a pair of lower projections 34, 34 integrally extending from the bottom plate 131, such that they correspond to the upper projections 125, 126 of the first doughnut-shaped member 120 in the second embodiment. Each lower projection 34 has a semicircular cross section tapered toward the columnar space 30*b*. With the lower projections 34, 34, the dislocation of a coil wire on the outer cylindrical wall 32 can be further suppressed. Because other portions than the lower projections 34, 34 are substantially the same as in the second doughnut-shaped member 30 in the first embodiment, their explanations will be omitted.

[4] Fourth Embodiment

Though the first doughnut-shaped members 20, 120 and the second doughnut-shaped members 30, 130 are in a cap shape containing a magnetic core in the above embodiments, the first doughnut-shaped members 20, 120 may be as large as containing the entire magnetic core. In this case, (a) the second doughnut-shaped member 30, 130 is a bottom lid for closing a lower end opening of the first doughnut-shaped member 20, 120, or (b) the second doughnut-shaped member 30, 130 is an upper lid for closing an upper end opening of the first doughnut-shaped member 20, 120. Taking the case (b) for example, detailed explanation will be made below.

Figure 13:
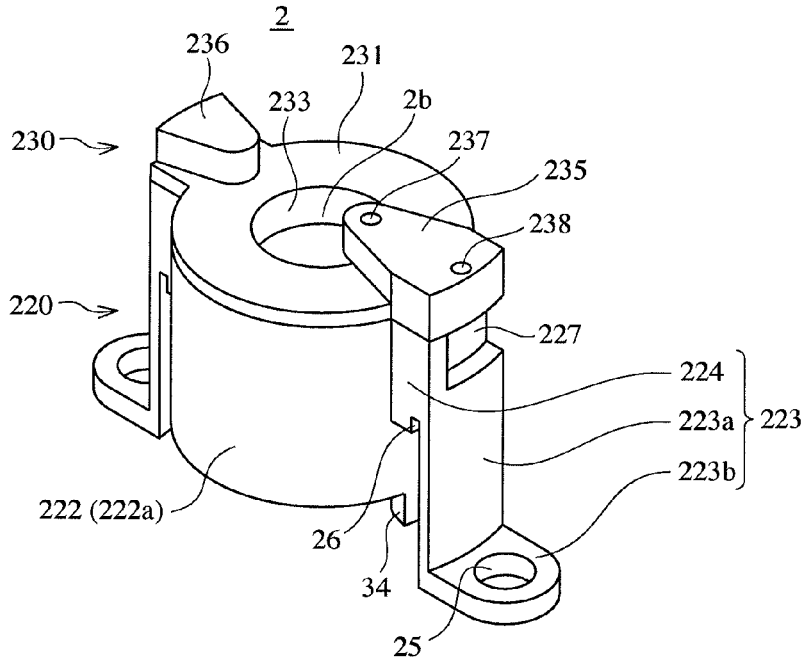
FIG. 13 is a perspective view showing the appearance of a first case in the fourth embodiment of the present invention.
Figure 14:
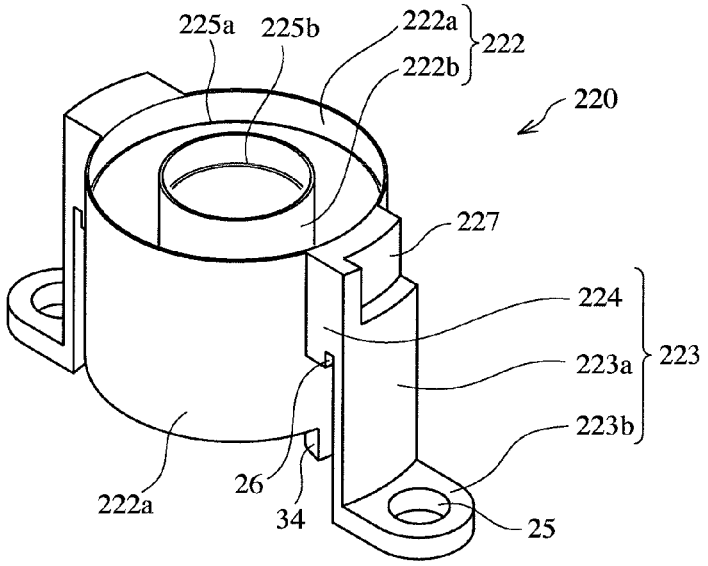
FIG. 14 is a perspective view showing the appearance of a first doughnut-shaped member constituting the first case of FIG. 13.
Figure 15:
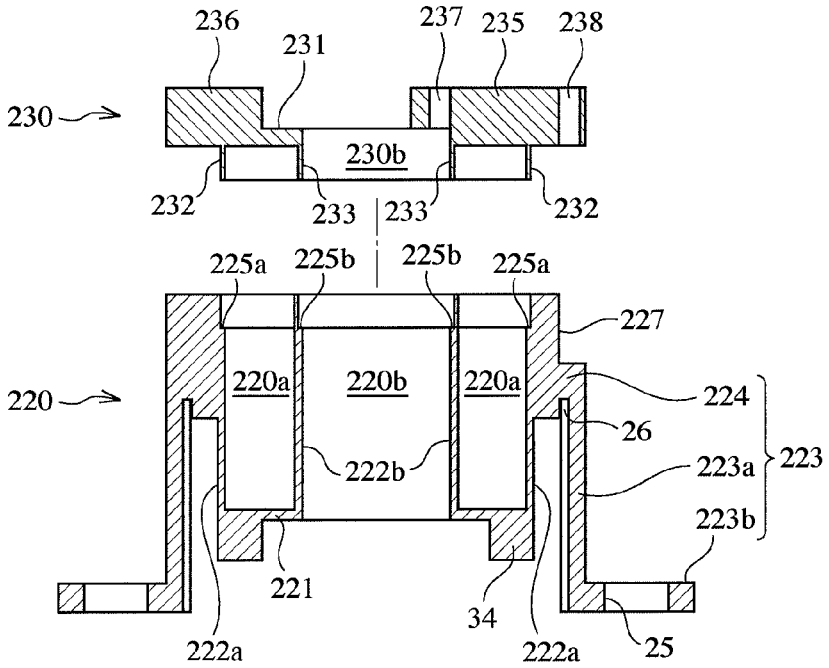
FIG. 15 is an exploded cross-sectional view showing the first case of FIG. 13.

In the example shown in FIGS. 13-15, the second doughnut-shaped member 230 open on the lower side engages from above the first doughnut-shaped member 220 open on the upper side. The first case 2 obtained by combining the first doughnut-shaped member 220 with the second doughnut-shaped member 230 has substantially the same appearance as in the second embodiment.

The first doughnut-shaped member 220 has a doughnut-shaped lower plate portion 221, a double-wall cylindrical portion 222, and pluralities (a pair in the depicted example) of legs 223 integrally extending downward from an outer surface of the double-wall cylindrical portion 222 in parallel with the center axis C (z direction). The double-wall cylindrical portion 222 comprises an outer cylindrical wall 222*a* and an inner cylindrical wall 222*b* integrally and concentrically extending upward from a cylindrical edge of the doughnut-shaped lower plate portion 221. The doughnut-shaped lower plate portion 221 and the concentric outer and inner cylindrical walls 222*a* and 222*b* define a one-side-closed annular space 220*a* having an upper open end for containing the annular magnetic core. The inner cylindrical wall 222*b* constitutes a columnar space 220*b*. The one-side-closed annular space 220*a* contains the annular magnetic core. The outer cylindrical wall 222*a* has a horizontal (perpendicular to the center axis C) annular step 225*a* on the inner surface near the upper end, and the inner cylindrical wall 222*b* has a horizontal (perpendicular to the center axis C) annular step 225*b* on the inner surface near the upper end. A side projection 224 of each leg 223 has a recess 227 facing the upper end. In the depicted example, the doughnut-shaped lower plate portion 221 of the first doughnut-shaped member 220 has a pair of the same lower projections 34 as in the third embodiment at positions corresponding to the upper projections 235, 236 of the second doughnut-shaped member 230.

The second doughnut-shaped member 230 acting as a lid comprises a doughnut-shaped upper plate portion 231 and concentric outer and inner cylindrical walls 232 and 233 integrally extending downward from the doughnut-shaped upper plate portion 231 along the center axis C. The doughnut-shaped upper plate portion 231 comprises a pair of substantially the same upper projections 235, 236 as in the second embodiment at positions corresponding to the side projections 224, 224 of a pair of legs 223 in the first doughnut-shaped member 220.

When the first doughnut-shaped member 220 containing the annular magnetic core is combined with the second doughnut-shaped member 230, the outer cylindrical wall 232 in contact with an inner surface of the outer cylindrical wall 222*a* of the first doughnut-shaped member 220 abuts the annular step 225*a*, and the inner cylindrical wall 233 in contact with an inner surface of the inner cylindrical wall 222*b* of the first doughnut-shaped member 220 abuts the annular step 225*b*. Thus obtained is a first case 2 containing the annular magnetic core in the closed double-wall cylindrical portion (annular portion). In FIG. 15, the annular magnetic core is omitted for simplicity.

The upper projection 235 of the second doughnut-shaped member 230 has a pair of guide holes 237, 238 as in the second embodiment. The guide hole 237 is open to the columnar space 220*b* of the first doughnut-shaped member 220, and one end portion of a coil wire extending from the penetrating center hole 2*b* of the first case 2 constituted by the first doughnut-shaped member 220 connected to the second doughnut-shaped member 230 passes through the guide hole 237. The guide hole 238 is open to the recess 227 of the side projection 224 of the first doughnut-shaped member 220, and the other end portion of the coil wire penetrates the guide hole 238 outside the double-wall cylindrical portion 222. Though the guide holes 237, 238 are penetrating holes in this embodiment, they may be notches open sideward.

[5] Fifth Embodiment

Figure 16:
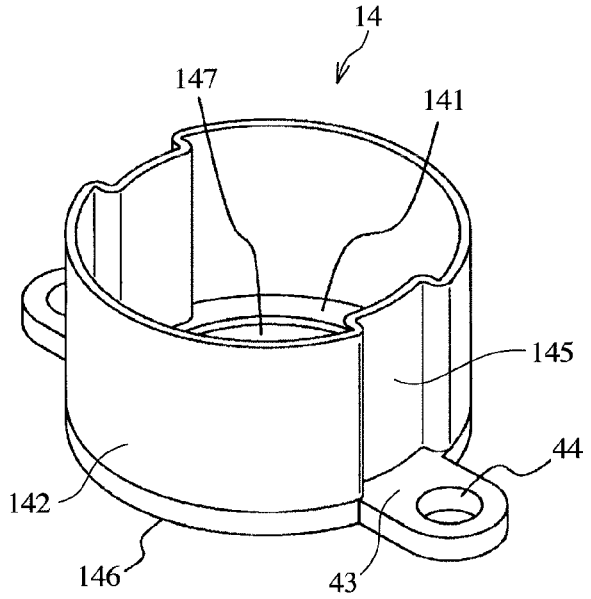
FIG. 16 is a perspective view showing the appearance of a second case in the fifth embodiment of the present invention.
Figure 17:
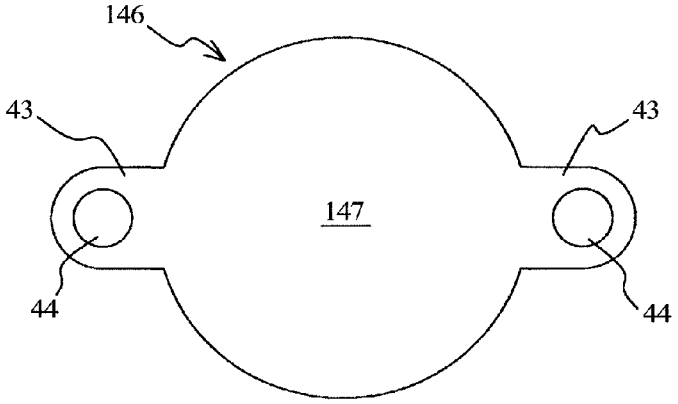
FIG. 17 is a plan view showing a second member (bottom plate) constituting the second case of FIG. 16.

FIG. 16 shows a second case 14 in the fifth embodiment of the present invention. The second case 14 is constituted by a vertical cylindrical portion 142 integrally having an annular bottom portion 141, and a bottom plate 146 fixed to the annular bottom portion 141. The cylindrical portion 142 is provided with vertical recesses 145 for receiving the extensions 23*a* of the legs 23 of the first case 2. As shown in FIG. 17, the bottom plate 146 comprises a circular portion 147, and a pair of fixing portions 43, 43 diametrically projecting therefrom, and each fixing portion 43 has a circular penetrating hole 44 at a position corresponding to the penetrating hole 25 of the leg 23. The bottom plate 146 may have uniform thickness. The cylindrical portion 142 is preferably made of an insulating resin as described above, and the bottom plate 146 is preferably made of a non-magnetic metal such as aluminum, magnesium, stainless steel, copper, etc.

When the bottom plate 146 is fixed to the annular bottom portion 141 of the cylindrical portion 142, the circular portion 147 of the bottom plate 146 is exposed in a center opening of the annular bottom portion 141, so that the bottom plate 146 can effectively act as a heat-dissipating plate. When the first case 2 and the second case 4 are assembled such that the extensions 23*a* of the legs 23 of the first case 2 enter the vertical recesses 145 of the cylindrical portion 142, the penetrating hole 25 of the first case 2 overlaps the penetrating hole 44 of the second case 14. As a result, the resultant case unit 1 can be fixed to a substrate by bolts.

[2] Electronic Device

Figure 18:
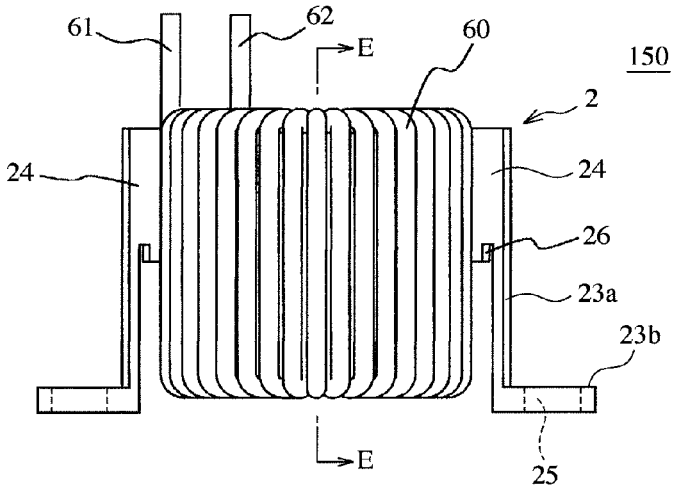
FIG. 18 is a front view showing a coil device comprising a coil wound around the first case in the first embodiment of the present invention.
Figure 19:
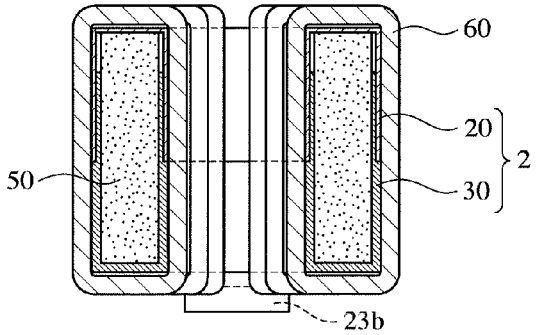
FIG. 19 is a cross-sectional view taken along the line E-E in FIG. 18.
Figure 20:
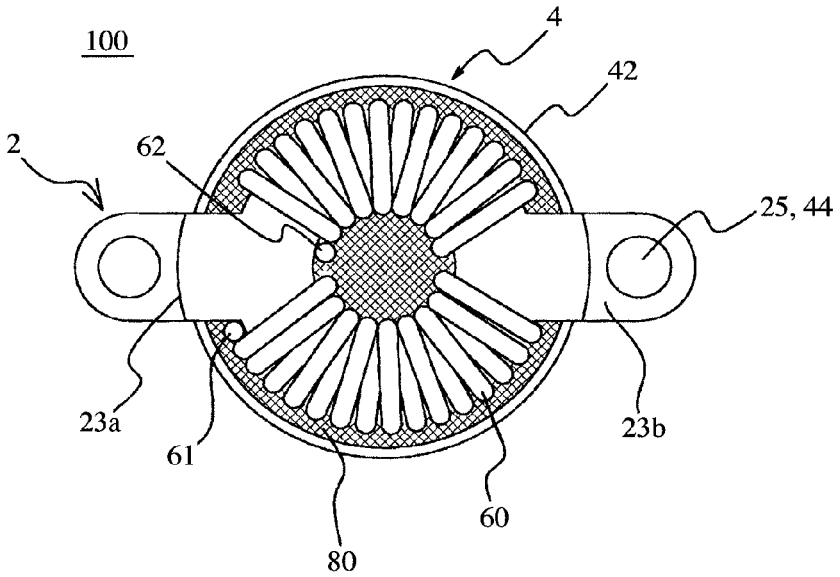
FIG. 20 is a plan view showing an electronic device comprising the case unit in the first embodiment of the present invention.
Figure 21:
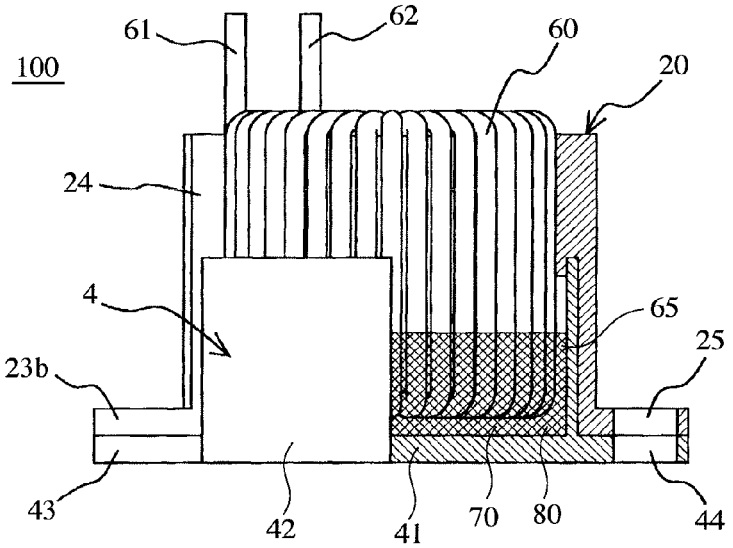
FIG. 21 is a partially cross-sectional front view showing the electronic device of FIG. 20.

Because the electronic device of the present invention can be constituted by the case unit in any embodiment, detailed explanation will be made below with respect to a case where the case unit in the first embodiment is used, for convenience. FIGS. 18 and 19 show a coil device 150 constituting an electronic device 100, and FIGS. 20 and 21 show an electronic device 100 containing the coil device 150 in the second case 4. In the coil device 150 shown in FIG. 18, both end portions 61, 62 of a coil 60 extend upward (in an opposite direction to the fixing portions 23*b* of the legs 23), and are connected to terminal members (not shown). Of course, the extending direction of both end portions 61, 62 of the coil 60 is not restrictive, but may be, for example, in a transverse direction (in a radial direction of the first case 2).

Figure 22:
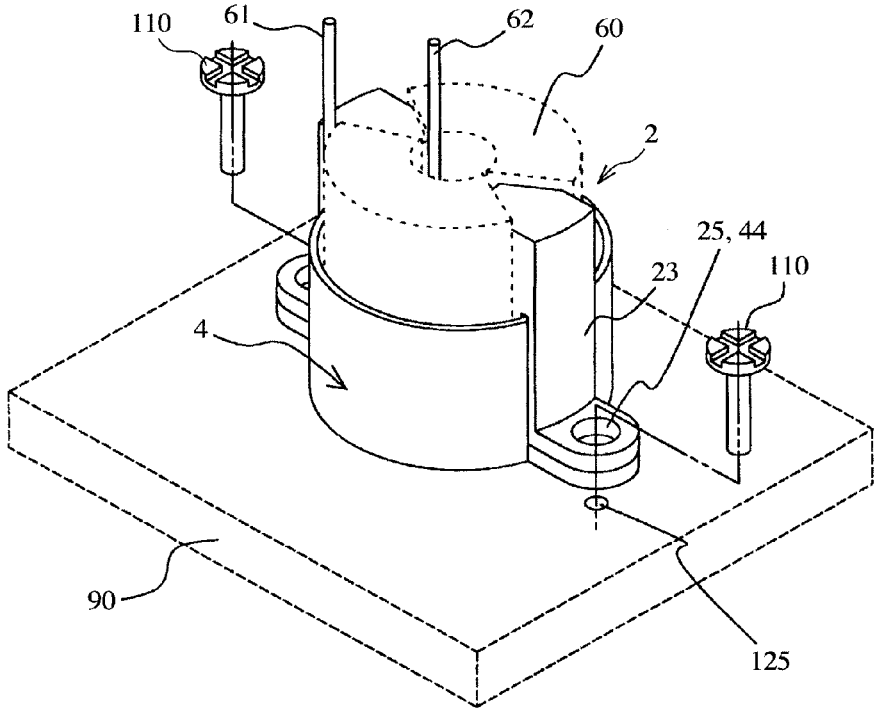
FIG. 22 is a perspective view showing the fixing of the electronic device of the present invention to a substrate.
Figure 23:
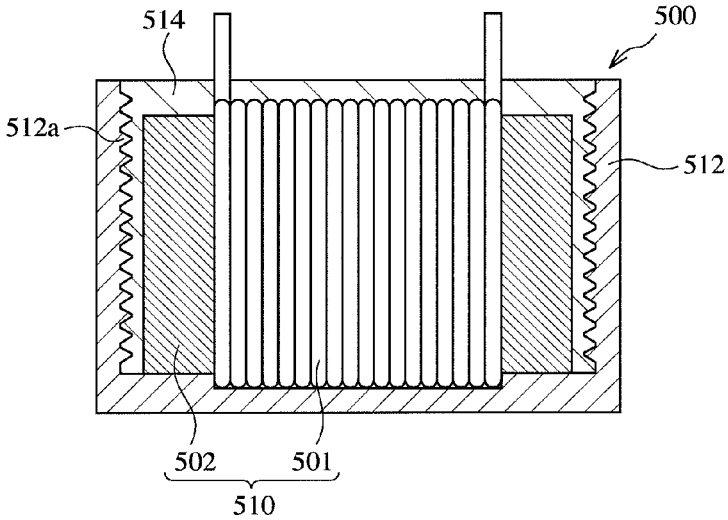
FIG. 23 is a cross-sectional view showing a conventional reactor.

As shown in FIG. 19, the electronic device 100 comprises the coil device 150 comprising the coil 60 wound around the first case 2 containing the annular magnetic core 50, and the second case 4 containing the coil device 150. The electronic device 100 is fixed to a substrate 90 such as an aluminum frame, etc. by bolts 110 as shown in FIG. 22.

First inserted into an annular space 30*a* defined by the outer cylindrical wall 32 and inner cylindrical wall 33 of the second doughnut-shaped member 30 is an annular magnetic core 50 having substantially the same shape as that of the annular space 30*a* as shown in FIG. 10. The outer cylindrical wall 32 and inner cylindrical wall 33 of the second doughnut-shaped member 30 then engage the outer and inner cylindrical walls 22*a*, 22*b* of the first doughnut-shaped member 20. Thus obtained is a first case 2 containing the annular magnetic core 50 in the closed annular space 2*a* of the closed double-wall cylindrical portion (annular portion) 200 as shown in FIG. 7. In FIG. 7, the annular magnetic core is omitted.

Usable as the annular magnetic core 50 are (a) laminate cores of electrical steel sheets, (b) toroidal or laminate cores of amorphous alloy ribbons of Fe—B—Si—C alloys, etc. or nano-crystalline alloy ribbons of Fe—B—Si—Cu—Nb alloys, etc., (c) molded cores of soft-magnetic Fe-based alloy powder of Fe—B—Si—C alloys, Fe—B—Si—Cu—Nb alloys, Fe—Si alloys, Fe—Ni alloys, Fe—Al alloys, Fe—Co alloys, Fe—Cr alloys, Fe—Si—M alloys (M is Cr or Al), etc. and binder resins, (d) ferrite cores, etc. The annular magnetic core 50 may be provided with a magnetic gap, if necessary. The annular magnetic core 50 may be constituted by fan- or column-shaped magnetic cores arranged via pluralities of magnetic gaps in an annular space 30*a*. The magnetic gaps may be provided by heat-resistant resins, non-magnetic ceramics, space, etc.

The coil 60 is formed by a conductive wire (for example, a copper wire enameled with polyamideimide) wound around the closed double-wall cylindrical portion (annular portion) 200 of the first case 2 containing the annular magnetic core 50. Though the conductive wire constituting the coil 60 may have various shapes such as circle, rectangle, etc. in cross section, the use of a conductive wire having a rectangular cross section provides the coil with a high space factor. The number of winding in the coil 60 may be properly determined based on the inductance required, and the diameter of the conductive wire may be properly selected depending on current supplied.

Because the entire magnetic core is contained in the annular space of the first case 2 made of an insulating resin, sufficient insulation is secured between the annular magnetic core and the coil 60, resulting in no insulation breakdown even if high voltage is applied to both ends of the coil 60.

Though one coil 60 is used in this embodiment, another monitoring coil may be contained in the closed double-wall cylindrical portion 200. In the case of a composite reactor, the number of coils may depend on the number of inductors.

The second case 4 is assembled to the first case 2, with the upper edge portions of the cylindrical portion 42 of the second case 4 inserted into the arcuate grooves 26 of the side projections 24 of the legs 23 of the first case 2. Accordingly, the coil 60 should be placed in a region inside the arcuate grooves 26 formed in the side projections 24 of the legs 23. In the z direction, the coil 60 does not reach the upper surface of the bottom plate 41 of the second case 4. The coil 60 is partially covered with the second case 4. A bottom surface of the bottom plate 41 of the second case 4 acts as a surface mounted to the substrate. When the second case 4 is made of an insulating resin, sufficient insulation is kept even if the coil 60 is close to the second case 4, so that the distance between the coil 60 and the substrate can be made smaller, resulting in higher heat dissipation.

The length of the legs 23 of the first case 2, the height of the cylindrical portion 42 of the second case 4, and the depth of the arcuate grooves 26 of the first case 2 are determined, such that when the fixing portions 23*b* of the legs 23 of the first case 2 are overlapped with the fixing portions 43 of the second case 4, (a) the upper edge portion of the cylindrical portion 42 of the second case 4 has slightly insufficient length to reach the deepest positions of the arcuate grooves 26 of the first case 2, and (b) there is a slight gap 70 between the coil 60 and the bottom plate 41 of the second case 4. The second case 4 need not entirely cover the double-wall cylindrical portion 22 of the first case 2, but may cover at least part thereof.

With the penetrating holes 25 of the fixing portions 23*b* of the first case 2 are temporarily fixed to the penetrating holes 44 of the fixing portions 43 of the second case 4 by positioning means such as pins, a liquid potting resin 80 is introduced into the second case 4 through the penetrating center hole 2*b* of the coil device 150, so that the coil 60 is immersed in the liquid potting resin 80. The liquid potting resin 80 filling the second case 4 is cured by heating.

Usable for the potting resin 80 are epoxy resins, silicone resins, urethane resins, etc., and insulation fillers having excellent heat conductivity, such as alumina, etc. may be added thereto. Because the addition of fillers increases the viscosity of the potting resin 80, a heated potting resin 80 is preferably introduced into a heated case unit 1. By filling under reduced pressure, pores can be removed from the potting resin 80.

To provide the electronic device with reduced size, improved heat dissipation, etc., the potting resin 80 is preferably introduced into as small space as possible, as long as sufficient insulation is kept, and the gaps between the coil 60 and the cylindrical portion 42 and bottom portion 41 of the second case 4 are preferably several millimeters or less. To fill such a narrow space with the potting resin 80, sufficient time should be used.

Without positioning the coil devices 150 in the second case 4 with equal intervals, spaces filled with the potting resin 80 are uneven among the electronic devices, providing the electronic devices with reduced insulation and heat dissipation. Using the case unit 1 of the present invention, the accurate positioning of the coil device 150 is achieved easily and surely. Accordingly, the electronic device comprising the case unit 1 of the present invention is uniformly filled with the potting resin 80, resulting in the potting resin 80 free from cracks and voids.

The potting resin 80, which is charged to such height as to ensure sufficient fixing strength, need not cover the entire coil device 150, because the first case 2 and the second case 4 in the case unit 1 of the present invention are both fixed to the substrate 90. Thus, the amount of the potting resin 80 may be small. Because the formation of the cylindrical portion 42 of the second case 4 by an insulating resin reduces a role of the potting resin 80 as an insulator, the amount of the potting resin 80 can be further reduced. When the second case 4 is made of a metal, a surface of the potting resin 80 may be at a position equal to or more than ¼ of the height of the coil 60 and lower than the upper end of the cylindrical portion 42 of the second case 4.

When the potting resin 80 is charged to a height at which the first doughnut-shaped member 20 and the second doughnut-shaped member 30 constituting the first case 2 are connected, the double-wall cylindrical portion 22 has increased air tightness, thereby preventing the rusting of the magnetic core of Fe-based alloys, etc.

As shown in FIG. 22, the substrate 90 has threaded holes 125 into which bolts 110 are inserted, at positions corresponding to the penetrating holes 25 of the first case 2 and the penetrating hole 44 of the second case 4. With the fixing portions 23*b* of the legs 23 of the first case 2 overlapping the fixing portions 43 of the second case 4, a bolt 110 penetrating each hole 25, 44 is threadably fixed to the threaded hole 125 of the substrate 90.

Heat generated by the coil 60 to which current is supplied is dissipated to the substrate 90 through the potting resin 80 and the second case 4. As described above, the electronic devices of the present invention exhibit excellent insulation and heat dissipation even when used for vehicles operated at high voltage and large current, and can be firmly fixed to the substrates.

EFFECTS OF THE INVENTION

Because the case unit of the present invention comprises (a) a first case having an annular portion for containing an annular magnetic core and having a coil wound around it, and pluralities of legs extending downward from the annular portion; and (b) a second case having a cylindrical portion extending from a bottom portion, and engaging the first case such that the cylindrical portion covers the annular portion; (c) the second case engaging the first case such that the cylindrical portion enters gaps between the annular portion and the legs, it can surely fix a coil device comprising a coil wound around an annular magnetic core, despite an easy-to-assemble simple structure.

Because the electronic device of the present invention comprising the case unit having such a structure comprises (a) a coil device comprising an annular magnetic core contained in the annular portion of the first case, and a coil wound around the annular portion of the first case; (b) a second case containing the coil device; and (c) a potting resin filling the second case to fix the coil device to the second case, the cracking of the potting resin can be reduced. Even if the electronic device of the present invention is mounted to power converters for vehicles subject to repeated mechanical vibration, it would not be detached therefrom, resulting in high reliability. Such electronic devices are suitable for power supply circuit apparatuses operable at high voltage and large current, such as reactors, transformers, choke coils, etc., and suitably mounted to hybrid vehicles, electric vehicles, etc., because of excellent heat dissipation and sure fixing.

What is claimed is:

1. A case unit for containing an annular magnetic core and a coil, which comprises a first case having an annular portion having an annular space for receiving said annular magnetic core, around which said coil is wound, and pluralities of legs extending from said annular portion to one side; and a second case engaging said first case, such that it enters gaps between said annular portion and legs of said first case, and covers part of said annular portion from said one side;

a first fixing portion of each leg of said first case and each second fixing portion of said second case being overlapped and fixed to a substrate.

2. The case unit according to claim 1, wherein each of said first fixing portion and said second fixing portion has a penetrating hole or a notch; and wherein said first and second fixing portions are fixed to said substrate by fastening parts with their penetrating holes or notches overlapped.

3. The case unit according to claim 1, wherein each leg of said first case comprises a side projection projecting from said annular portion, an extension extending from said side projection to one side, and said fixing portion provided in a tip end portion of said extension.

4. The case unit according to claim 3, wherein one of plural legs of said first case has a side projection projecting outward from said annular portion, an upper projection projecting from an upper surface of said annular portion integrally with said side projection, an extension extending downward from said side projection, and said fixing portion provided in a tip end portion of said extension; and wherein said upper projection has at least one penetrating hole or notch through which an end portion of a coil wire penetrates.

5. The case unit according to claim 3, wherein said side projection of said first case has a groove for receiving a cylindrical portion of said second case.

6. The case unit according to claim 1, wherein said annular portion of said first case is constituted by a first doughnut-shaped member and a second doughnut-shaped member telescopically engageable with each other; and wherein said legs extend from said first doughnut-shaped member.

7. The case unit according to claim 6, wherein said first doughnut-shaped member has a first annular space having an open end; wherein said second doughnut-shaped member has a second annular space having an open end; and wherein when said first doughnut-shaped member engages said second doughnut-shaped member, said first annular space is integrally connected to said second annular space to constitute a closed annular space for receiving said annular magnetic core.

8. The case unit according to claim 6, wherein said first doughnut-shaped member has a lower open end; wherein said second doughnut-shaped member has an upper open end; and wherein said first doughnut-shaped member engages said second doughnut-shaped member from above.

9. The case unit according to claim 6, wherein said first doughnut-shaped member has an upper open end; wherein said second doughnut-shaped member has a lower open end; and wherein said first doughnut-shaped member engages said second doughnut-shaped member from below.

10. The case unit according to claim 1, wherein said second case is constituted by a first member having said cylindrical portion, and a second member having a bottom plate; wherein said first member is made of an insulating resin; and wherein said second member is made of a metal.

11. The case unit according to claim 10, wherein a lower end of said cylindrical portion of said first member is integrally provided with an annular bottom portion; and wherein said annular bottom portion of said first member is fixed to said bottom plate of said second member, so that said bottom plate is exposed in a center opening of said annular bottom portion.

12. The case unit according to claim 1, wherein said cylindrical portion of said second case has recesses extending along a center axis for receiving said legs of said first case.

13. The case unit according to claim 10, wherein said second member has fixing portions integral with said bottom plate.

14. An electronic device comprising the case unit recited in claim 1, comprising a coil device comprising an annular magnetic core contained in said annular portion of said first case, and a coil wound around said annular portion of said first case;

the second case containing said coil device; and a potting resin filling said second case for fixing said coil device to said second case.

* * * * *